US007988651B2

(12) United States Patent
Cook et al.

(10) Patent No.: US 7,988,651 B2
(45) Date of Patent: Aug. 2, 2011

(54) INFLATABLE DEVICE FOR USE IN IMPULSE THERAPY

(75) Inventors: Gordon Cook, Hampshire (GB); Graeme Follett, Hampshire (GB)

(73) Assignee: Covidien AG (CH)

( * ) Notice: Subject to any disclaimer, the term of this patent is extended or adjusted under 35 U.S.C. 154(b) by 0 days.

(21) Appl. No.: 12/606,164

(22) Filed: Oct. 26, 2009

(65) Prior Publication Data

US 2010/0049107 A1 Feb. 25, 2010

Related U.S. Application Data

(63) Continuation of application No. 10/523,023, filed as application No. PCT/GB03/03348 on Jul. 31, 2003, now Pat. No. 7,708,707.

(51) Int. Cl.
*A61H 7/00* (2006.01)

(52) U.S. Cl. ..... 601/152; 602/13; 602/27

(58) Field of Classification Search ..... 602/13, 602/20–22, 23–29; 128/882, DIG. 20
See application file for complete search history.

(56) References Cited

U.S. PATENT DOCUMENTS

| | | | | |
|---|---|---|---|---|
| 4,135,500 | A * | 1/1979 | Gorran | 601/150 |
| RE34,661 | E * | 7/1994 | Grim | 602/27 |
| 5,353,525 | A * | 10/1994 | Grim | 36/88 |
| 5,496,262 | A * | 3/1996 | Johnson et al. | 601/152 |
| 5,588,955 | A * | 12/1996 | Johnson et al. | 601/152 |
| 6,228,044 | B1 | 5/2001 | Burek et al. | |
| 6,425,195 | B1 | 7/2002 | Donzis | |
| 6,592,534 | B1 * | 7/2003 | Rutt et al. | 601/151 |
| 7,282,038 | B2 * | 10/2007 | Gillis et al. | 601/151 |
| 7,691,084 | B2 * | 4/2010 | Knighton et al. | 604/133 |

FOREIGN PATENT DOCUMENTS

| | | | |
|---|---|---|---|
| JP | 09262261 | A | 7/1997 |
| WO | WO-95 01770 | A | 1/1995 |
| WO | WO-01 47464 | A | 7/2001 |
| WO | WO-02 02181 | A | 1/2002 |

OTHER PUBLICATIONS

Office Action issued Aug. 31, 2010 from related Canada Patent Application Serial No. 2493617, 3 pgs.

* cited by examiner

*Primary Examiner* — Michael A. Brown
(74) *Attorney, Agent, or Firm* — Thomas M. Johnston, Esq.

(57) ABSTRACT

A device for use in applying impulse therapy to a limb of a human body and including an inflatable bladder or pad that has opposing hermetically sealed first and second side walls. The device also includes an inlet tube connected to the inflatable bladder or pad for feeding intermittent pulses of fluid to the inflatable bladder or pad. The inflatable bladder or pad includes a fluid dispersal and noise reducing internal media interposed between the first and second side walls and over an outlet of the inlet tube, the fluid dispersal and noise reducing internal media configured to dissipate the intermittent pulses of fluid with an accompanying reduction in a fluid flow rate and noise generated during pressurization of the inflatable bladder or pad.

12 Claims, 4 Drawing Sheets

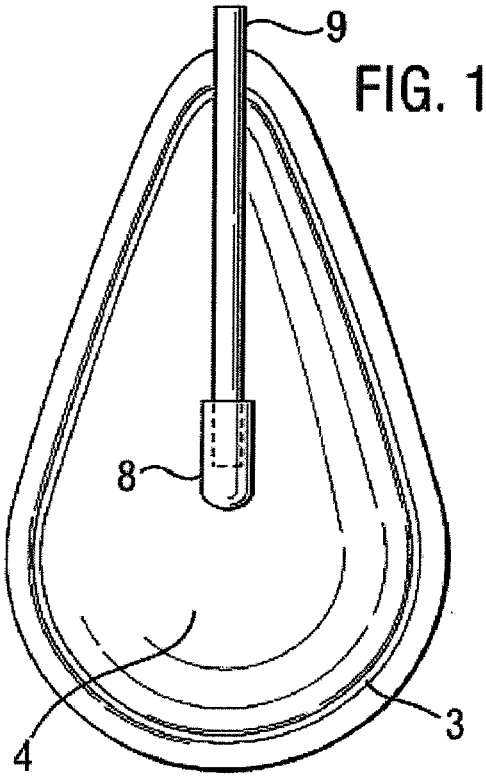
FIG. 1
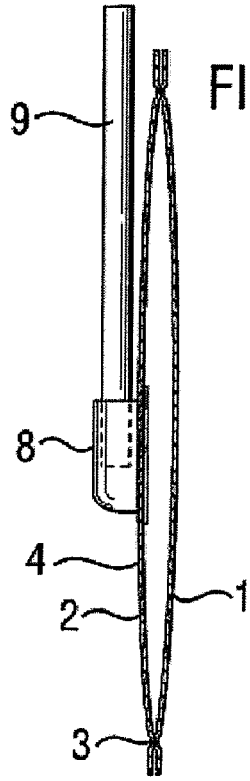
FIG. 2
FIG. 3
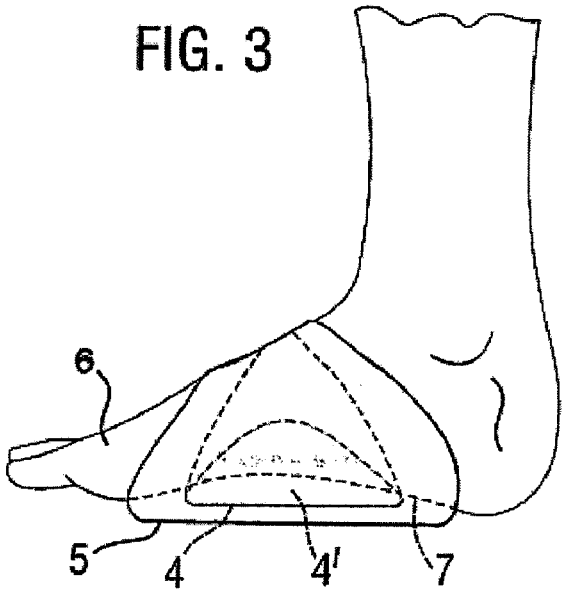
FIG. 4
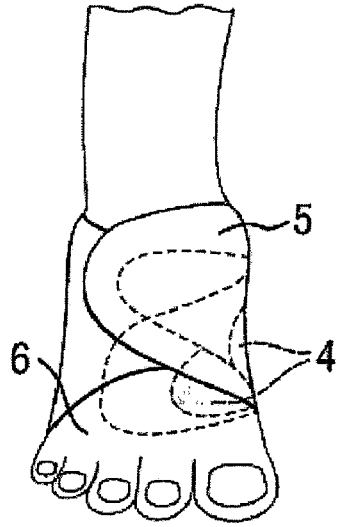

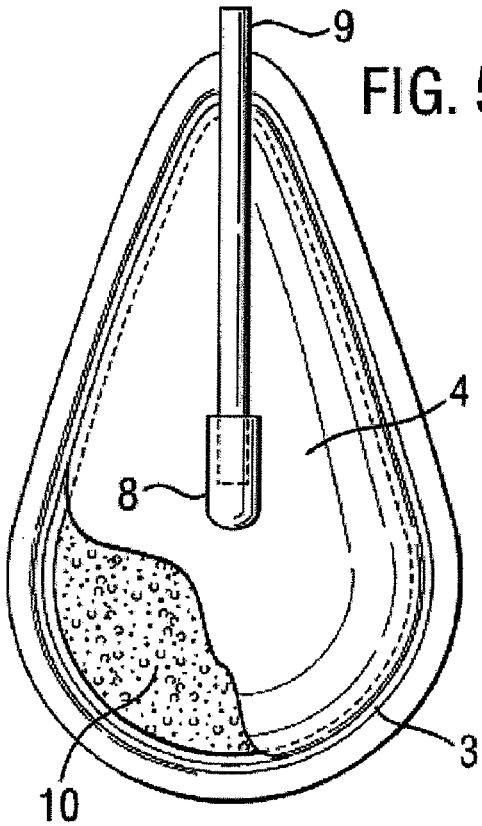
FIG. 5
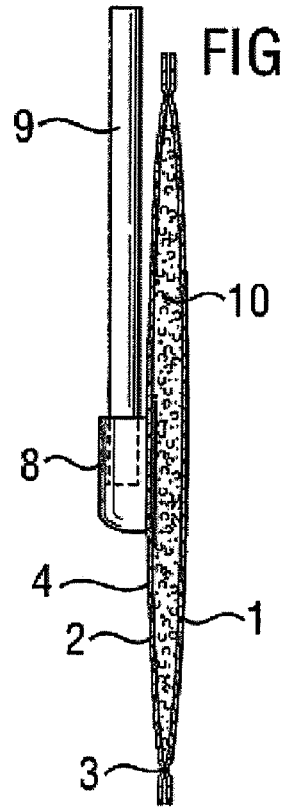
FIG. 6
FIG. 7
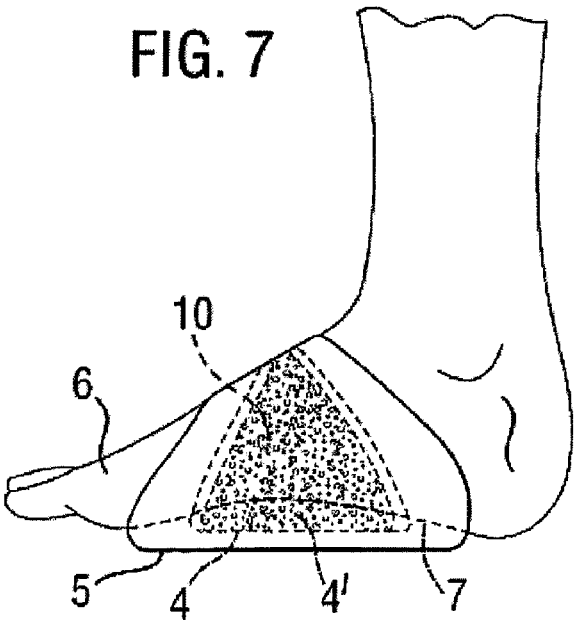
FIG. 8
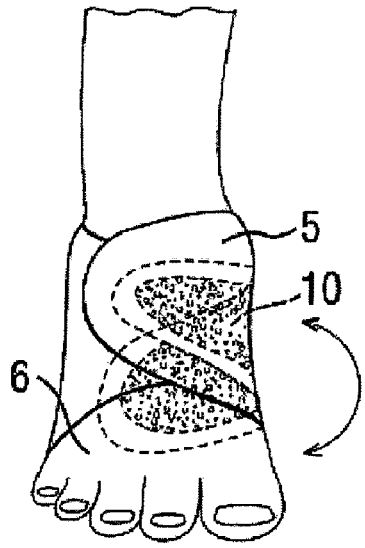

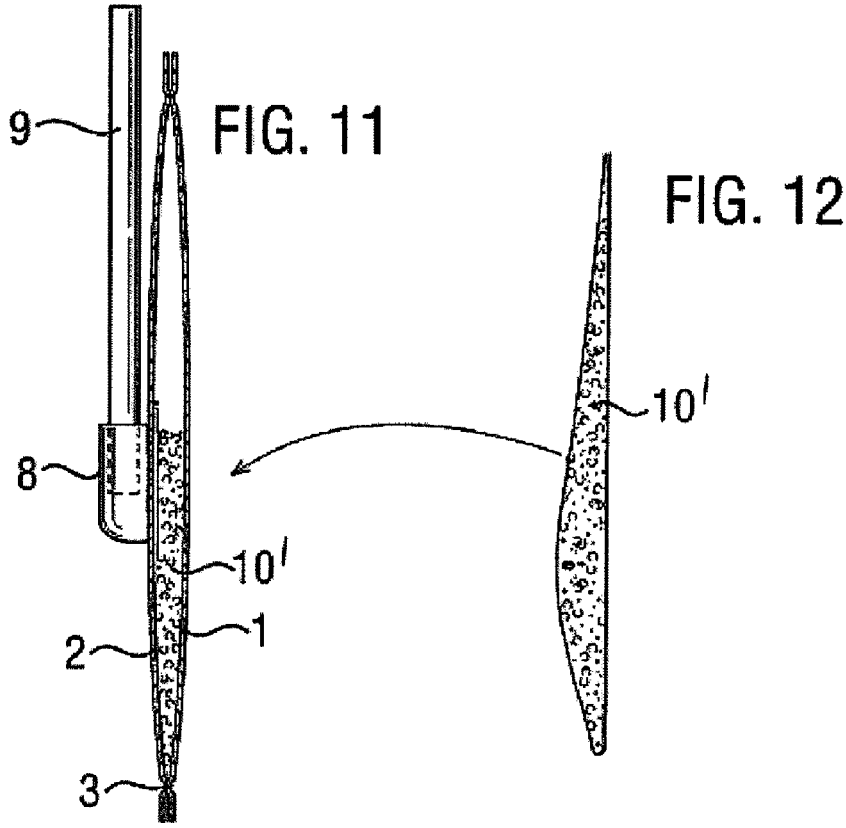
FIG. 11
FIG. 12
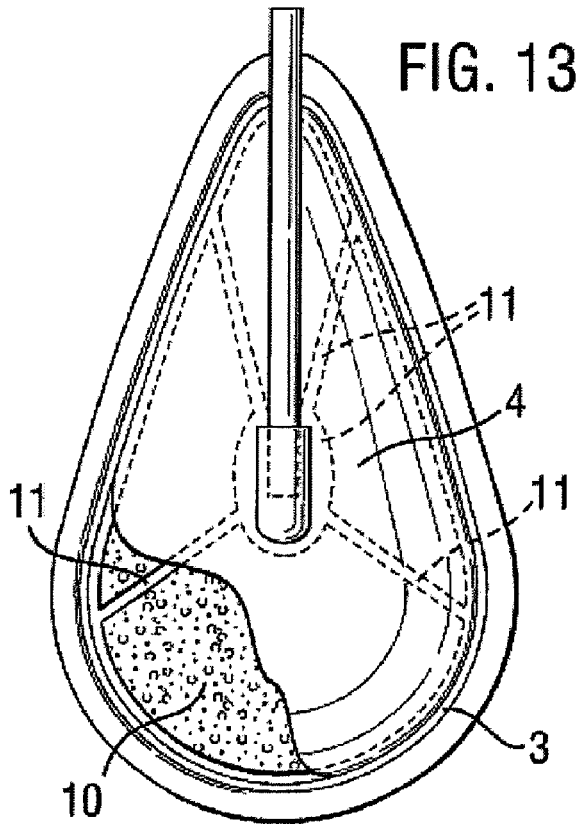
FIG. 13

INFLATABLE DEVICE FOR USE IN IMPULSE THERAPY

This application is a continuation of application Ser. No. 10/523,023 filed on Nov. 7, 2005 now U.S. Pat. No. 7,708,707, which is the national phase under 35 U.S.C. §371 of PCT International Application No. PCT/GB03/03348 which has an International filing date of Jul. 31, 2003 and for which priority is claimed under 35 U.S.C. §119 to Application No. GB0217996.8 filed in United Kingdom on Aug. 2, 2002; the entire contents of all are hereby incorporated by reference.

FIELD OF THE INVENTION

The present invention relates to a device for use in intermittent impulse therapy, particularly but not exclusively for applying intermittent impulse pressure to a human foot to enhance blood circulation around the body.

BACKGROUND OF THE INVENTION

The use of an inflatable garment applied to a limb or other area of the human body as a means of enhancing blood circulation is a well established medical technique with proven clinical benefits.

Such a device, known as the A-V Impulse System® is in widespread use and is designed to apply intermittent impulses to the foot in such a manner as to mimic ambulatory movement which is known periodically to empty the veins of the foot to drive the blood throughout the body.

The A-V Impulse System® comprises an inflatable bladder being part of or integral with means in the form of a foot wrap for securing the bladder in the plantar arch of the foot and about the area to be treated.

During use the bladder is filled with a fluid such as air to expand and apply cyclical force to the plantar arch directed in such a way as to empty the plantar veins of the foot.

The bladder is held pressurized for a period before releasing the fluid and then the cycle is repeated.

The rate of filling or venting of the bladder may vary from fractions of a second to several seconds according to application, but is dependent upon the bladder volume, fluid flow rate and operating pressure.

To be effective the bladder has to be filled rapidly and the consequent high velocity flow of fluid results in the generation of noise as the fluid passes from the controlling system through the connecting tubing into the bladder.

Noise reduction may be achieved by reducing the fluid flow rate but this is not a feasible remedy because it affects the required rate of pressurization and desired operating characteristics.

SUMMARY OF THE INVENTION

It is an object of the present invention to overcome the disadvantages of the prior art by providing the inflatable bladder with an internal volume reducing media or component providing means whereby the same bladder pressurization is achievable with a lower rate of fluid flow compared with the prior art. A lower rate of fluid flow means lower fluid usage and a reduction in the generation of noise which occurs when the bladder is being filled. Thus patient comfort is increased while maintaining the effectiveness of the therapy treatment.

According to the present invention there is provided a device for use in applying impulse therapy to a limb of the human body comprising an inflatable bladder, means for providing intermittent pulses of fluid to the bladder in accordance with a pre-determined timed sequence of pressure hold and pressure release, means for securing the bladder around the limb of the human body to apply the bladder to the area to be treated, characterized in that the bladder is provided with a volume reducing internal component which acts to dissipate the flow of fluid into the bladder with accompanying reduction in fluid flow rates and noise generated by the fluid flow during pressurization of the bladder.

Preferably the internal media is of foam material which may be attached to internal walls of the bladder or fitted loosely within the bladder without attachment.

It may be advantageous to provide the foam with channels for movement of pressurized air within the bladder.

Other features and advantages will now be described with reference to a set of accompanying drawings.

BRIEF DESCRIPTION OF THE DRAWINGS

The invention will now be described by way of example with reference to the accompanying drawings wherein:

FIGS. 1 and 2 show, in plan and cross-sectional view respectively, a device for applying impulse therapy to a human foot;

FIGS. 3 and 4 show respectively a side and front view of the device of FIGS. 1 and 2 as applied to a human foot;

FIGS. 5 and 6 show in plan and cross-sectional view respectively, a device for impulse therapy of the human foot in accordance with the invention;

FIGS. 7 and 8 show the a side and front view respectively of the device of FIGS. 5 and 6 applied to a human foot;

FIG. 11 is a cross-sectional view of the device of FIG. 9;

FIG. 12 is a cross-sectional view through the internal media within the bladder of the device of FIG. 10 illustrating a preferential profile of the internal media designed to occupy the plantar arch of the foot; and FIG. 13 shows a plan view of the device in accordance with the invention with part of the outer covering of the device cut away to reveal the internal media of the bladder provided with air flow channels cut into the media.

BEST MODES OF CARRYING OUT THE INVENTION

Figure 9:
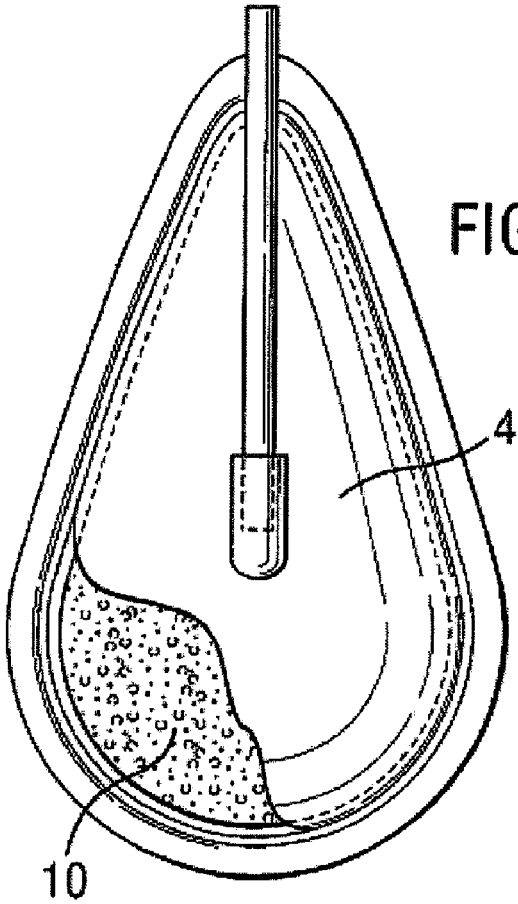
FIG. 9 shows the device of FIGS. 5 and 6 with part of the outer covering cut away to show the internal media of the bladder of the device.

A device for intermittent impulse therapy to be applied to the human foot is shown in FIGS. 1, 2, 3 and 4 in accordance with the prior art.

The device comprises an inflatable bladder or pad formed from two films 1, 2 of flexible polymeric material joined at the periphery 3 by, for example, radio frequency (RF) welding to form an essentially sealed pressure vessel or bladder 4.

The bladder 4 is formed integral with a foot wrap 5, see FIG. 3, which can be secured, as by Velcro action, around the foot 6 as shown in FIGS. 3 and 4 to hold the bladder 4 generally within the plantar arch 7 of the foot 6 with a void 4 between the bladder 4 and foot arch.

A port connection 8 is sealed to one of the films 1, 2 of the bladder 4 with a connection tube 9 attached to the port 8 to allow air to be admitted and vented from the bladder 4.

As pressurized air is fed to the bladder 4, the bladder 4 is free to expand particularly into the arch 7 of the foot 6 and elsewhere over the bladder surface area, being constrained only by the foot itself and by resistance to outward expansion of the wrap 5 to which the bladder is attached.

During inflation of the bladder 4 air flows through the port connection 8 at high velocity which generates excessive noise caused by the geometry within the flow path of the air and by pressurized air impinging directly on to the inner wall 5 of the bladder 4 opposite the port connections 8.

It is to the elimination of the excessive noise caused by the movement of pressurized air as described that the present invention is directed and in this way to improve the performance of the impulse therapy device and enhance patient fit up, comfort and well-being.

The improved impulse therapy device in accordance with the invention is illustrated in FIGS. 5 through 13.

In these embodiments the device itself is constructed in accordance with the prior art as discussed with reference to FIGS. 1 through 4 with the exception that in accordance with the invention the bladder 4 is provided with an internal media 10 in the form preferably of a foam, gel or fluid reservoir which reduces the internal volume of the bladder. The internal media in accordance with the invention may be attached to one or other, or both, films of the bladder 4. Alternatively, it may be freely inserted within the bladder 4.

The internal media acts to dissipate the flow of fluid within the bladder thus reducing noise and also the amount of fluid necessary to achieve the required rate of pressurization.

The improved bladder 4 of the impulse therapy device in accordance with the invention may be constructed by forming the internal media 10 by an injection molding process, either applied to bladders formed in accordance with the prior art or as part of multi-shot process to manufacture a bladder with an internal media by automated means, using for example a thermoplastic elastomer polymer together with a foaming technique to produce an integral cellular construction as the internal media.

The improved impulse therapy device in accordance with FIGS. 5 and 6 is shown applied to a human foot in FIGS. 7 and 8 in like manner as with the conventional impulse therapy device illustrated in FIGS. 3 and 4.

Figure 10:
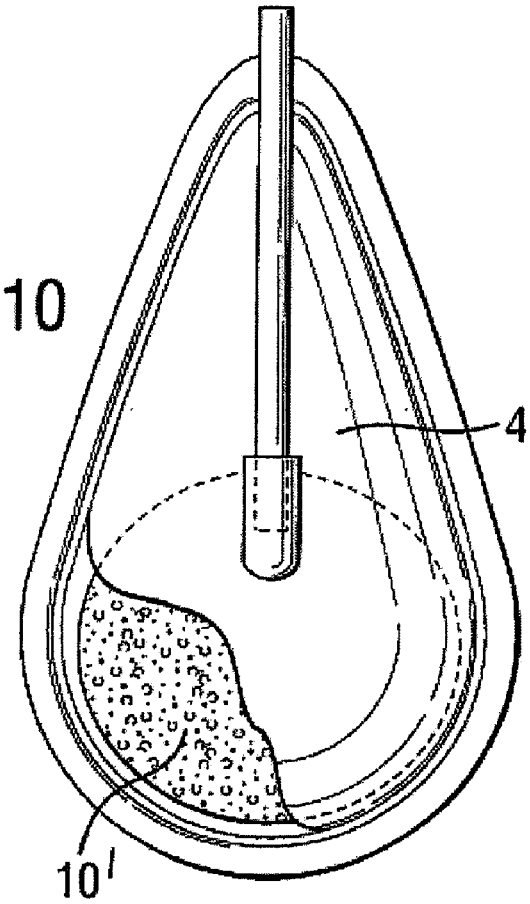
FIG. 10 shows a plan view of the device of FIGS. 5 and 6 with part of the outer covering of the device cut away to reveal the internal media of the bladder partly-filled by an amount sufficient to occupy the plantar arch of the human foot.

Whereas in the FIG. 5 embodiment the media 10 fills the entire space within the bladder 4, in alternative form (as shown in FIGS. 10, 11 and 12) the media may be appropriately profiled media 10' within the bladder such that when the device is applied to the foot the media conforms to the plantar arch 7.

The internal media 10 may be constructed from either a closed cell or open cell form according to the desired benefits of internal bladder volume reduction consistent with suitable air flow either immediately through and within the media, with channels 11 formed or cut into the media as shown in FIG. 13 or over and around the media.

The inclusion of an internal media within the bladder of the impulse therapy device as described above and in accordance with the invention, has significant actual and perceived implications for user comfort leading to improved product acceptance, compliance and clinical results.

In addition, a specific improvement has been observed when using the improved impulse therapy device in accordance with the invention fitted more loosely than is recommended with the prior art device as described with reference to FIGS. 1 through 4. Without inclusion of the internal media within the bladder it is necessary to fit the garment to the foot relatively snugly to avoid over-inflation and thus excessive air consumption. A disadvantage of such a fit-up is to cause a static force to be applied to the limb throughout the uninflated phase of applied impulse pressure thereby to some extent hindering re-priming of the veins of the foot following evacuation.

With the inclusion of the internal media the necessity to tighten the device as snugly as previously is reduced and consequently the static force on the foot is lessened allowing superior re-priming of the veins of the foot to occur.

The invention claimed is:

1. A device for use in applying impulse therapy to a limb of a human body, comprising:

an inflatable bladder or pad comprising a first side wall and second side wall opposite of the second side wall, each side wall hermetically sealed along a corresponding side wall periphery;

an inlet tube connected to the inflatable bladder or pad and configured to feed intermittent pulses of fluid to the inflatable bladder or pad in accordance with a predetermined timed sequence of pressure hold and pressure release, the inlet tube being secured to the first side wall so that the intermittent pulses of fluid are directed toward an inner surface of the second side wall; and a device configured to secure the inflatable bladder or pad around the limb of the human body, wherein the inflatable bladder or pad comprises a fluid dispersal and noise reducing internal media interposed between the first and second side walls and opposite a location where fluid leaving the inlet tube enters the inflatable bladder, the fluid dispersal and noise reducing internal media configured to dissipate the intermittent pulses of fluid with an accompanying reduction in a fluid flow rate and noise generated during pressurisation of the inflatable bladder or pad.

2. The device of claim 1, wherein the fluid dispersal and noise reducing internal media comprises a cellular foam material.

3. The device of claim 2, wherein the cellular foam material is attached to one of the first and second side wall.

4. The device of claim 3, wherein the cellular foam material is provided with air flow channels formed in a surface of the cellular foam material and extending along the surface.

5. The device of claim 1, wherein the fluid dispersal and noise reducing internal media comprises a gel.

6. The device of claim 1, wherein the fluid dispersal and noise reducing internal media comprises a fluid reservoir.

7. The device of claim 1, wherein the fluid dispersal and noise reducing internal media is a cellular component which fills or partially fills an interior of the inflatable bladder or pad.

8. The device of claim 7, wherein the cellular component comprises an injection moulded sound absorbing media formed integrally with the inflatable bladder or pad.

9. The device of claim 8, wherein the cellular component comprises a foam material.

10. The device of claim 1, wherein the internal media is profiled such that a thickness of the media varies along a length of the media forming and arch-like shape.

11. The device of claim 1, wherein the internal media occupies an entire deflated interior space of the bladder.

12. The device of claim 1 wherein further comprising a port connector connected directly to a first wall of the bladder and free of direct connection to the second wall, the inlet tube being connected to the port connector.

* * * * *